US006220579B1

(12) United States Patent
Chen

(10) Patent No.: US 6,220,579 B1
(45) Date of Patent: Apr. 24, 2001

(54) WARM MIST HUMIDIFIER

(76) Inventor: Tsu-Hsiu Chen, 150 S. Reservoir St. Unit #H, Pomana, CA (US) 91766

( * ) Notice: Subject to any disclaimer, the term of this patent is extended or adjusted under 35 U.S.C. 154(b) by 0 days.

(21) Appl. No.: 09/138,893

(22) Filed: Aug. 24, 1998

(51) Int. Cl.[7] ..... B01F 3/04

(52) U.S. Cl. ..... 261/131; 261/30; 261/142; 261/DIG. 65; 96/224

(58) Field of Search ..... 261/30, 66, 131, 261/137, 142, DIG. 65; 96/224

(56) References Cited

U.S. PATENT DOCUMENTS

| | | | | |
|---|---|---|---|---|
| 3,723,707 | * | 3/1973 | Wunderlin | 261/142 |
| 4,752,423 | * | 6/1988 | Wong | 261/142 |
| 4,869,853 | * | 9/1989 | Chen | 261/142 |
| 4,906,417 | * | 3/1990 | Gentry | 261/30 |
| 5,073,967 | * | 12/1991 | Marino | 261/142 |
| 5,131,070 | * | 7/1992 | Chiu et al. | 261/142 |
| 5,677,982 | * | 10/1997 | Levine et al. | 392/405 |
| 5,741,444 | * | 4/1998 | Kasuli | 261/142 |
| 5,859,952 | * | 1/1999 | Levine et al. | 392/405 |

FOREIGN PATENT DOCUMENTS

| | | | | |
|---|---|---|---|---|
| 4-76338 | * | 3/1992 | (JP) | 261/142 |

* cited by examiner

*Primary Examiner*—C. Scott Bushey
(74) *Attorney, Agent, or Firm*—Armstrong, Westerman, Hattori, McLeland & Naughton

(57) ABSTRACT

A warm mist humidifier with a fan and a germicidal bulb to facilitate the dispersion of water vapor and the elimination of potentially harmful microorganisms in water. The humidifier includes a base unit having an energizing circuit, a water tank having a weight sensor and disposed on the base unit for supplying water to the base unit, a reservoir in the base unit for receiving water from the water tank, a heating assembly disposed in the base unit for vaporizing water received from the reservoir when the heating assembly is activated by the energizing circuit, and a tank switch for activating or deactivating the energizing circuit. The tank switch is responsive to a change of position of the water tank relative to the base unit in response to the water in the water tank. The heating assembly is consisted of a boiler cavity, a heating coil fixedly mounted underneath the boiler cavity, an insulative outer housing mounted on the boiler cavity, and a removable cover covering the insulative outer housing.

13 Claims, 7 Drawing Sheets

WARM MIST HUMIDIFIER

BACKGROUND OF THE INVENTION

1. Field of the Invention

This invention generally relates to humidifiers or vaporizers. More specifically, this invention is directed to a warm mist humidifier for use in domestic applications.

2. Description of the Prior Art

Various types of humidifier devices are used to provide moisture to indoor air. Included among such humidifiers are ultrasonic humidifiers, steam humidifiers or vaporizers, warm mist humidifiers and evaporative humidifiers. The beneficial effects of these humidifiers are numerous and include: protection to the respiratory system of the user, reducing dryness and irritation in the user's nose and throat, reduction in static electricity, and protection of wood furniture, paneling and fabrics.

The warm mist type humidifiers have been effectively used to achieve very high humidification levels. Conventional humidifiers of the warm mist type usually produce a warm mist (rather than steam produced by the steam vaporization type humidifiers) into the environment to be humidified. Typical warm mist humidifiers employ an electric heater coil, which is in direct contact with water, for converting water contained in a reservoir into vapor. Additionally, the humidifiers may employ a float switch for activating or deactivating the heating coil based on the water level sensed by the float switch. The vapor in the humidifiers will rise through a vapor passage and mix with air drawn from an electric blower. Alternatively, the vapor can be produced in combination with a vaporized medicament for the treatment of colds, coughs, or other disorders of the respiratory system.

The conventional warm mist humidifier constructed as described above has many disadvantages. For example, minerals in the water are easily deposited on the surface of the heating coil which is made of a metal such as stainless steel or graphite. As a result, the electrical conductivity of the surface of the coil can deteriorate and it is often difficult to clean the stain on the surface of the coil. A float switch typically found in the conventional warm mist humidifier for activating or deactivating the heating coil according to the sensed water can easily deteriorate since it floats on water and is in direct contact with water. Additionally, moist on the heating coil or the float switch can attract potentially harmful microorganisms, thereby creating a higher amount of bacteria count in the mist.

SUMMARY OF THE INVENTION

In view of the foregoing disadvantages with the prior art device, it is the object of the present invention to provide a warm mist humidifier which has the same advantages as the aforementioned prior art humidifier, yet allows the humidifier to have a durable heating assembly that is easy to maintain.

It is still another object of the invention to provide a warm mist humidifier which automatically shuts off the heating assembly when the water level in a water tank is low without having to come in contact with water or to remove the water tank.

It is yet another object of the invention to provide a warm mist humidifier that eliminates the potentially harmful microorganisms in the water.

The above objects are achieved by a warm mist humidifier with an air blower comprising: a base unit having an energizing circuit; a water tank having a pressure sensor and disposed on the base unit for supplying water to said base unit; a reservoir in the base unit for receiving water from the water tank; a heating assembly disposed in the base unit for vaporizing water received from the reservoir when the heating assembly is activated by the energizing circuit; and a tank switch for activating or deactivating the energizing circuit, wherein the tank switch is responsive to a change of position of the water tank relative to the base unit in response to the water in the water tank. In particular, the heating assembly in the humidifier consists of a boiler cavity, a heating coil fixedly mounted underneath the boiler cavity, an insulative outer housing mounted on the boiler cavity, and a removable cover covering the insulative outer housing.

Other features and advantages of the invention will become apparent upon reference to the following Description of the Preferred Embodiment when read in light of the attached drawings.

BRIEF DESCRIPTION OF THE DRAWINGS

The present invention will be more clearly understood from the following description in conjunction with the accompanying drawings, where.

DESCRIPTION OF THE PREFERRED EMBODIMENT

Figure 1:
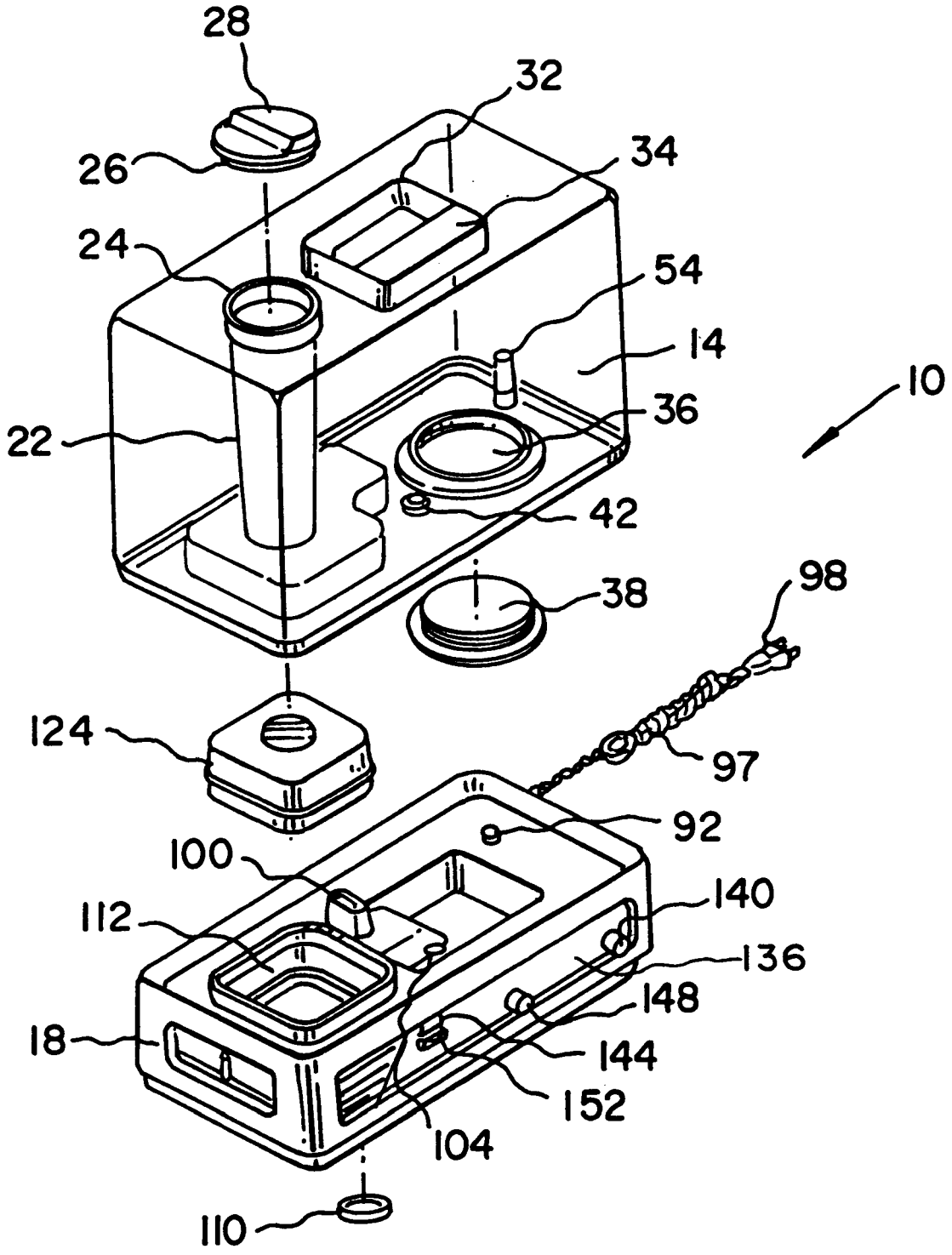
FIGS. 1 and 1A are partly exploded, perspective view of a preferred embodiment of a warm mist humidifier in accordance with the invention.
Figure 1A:
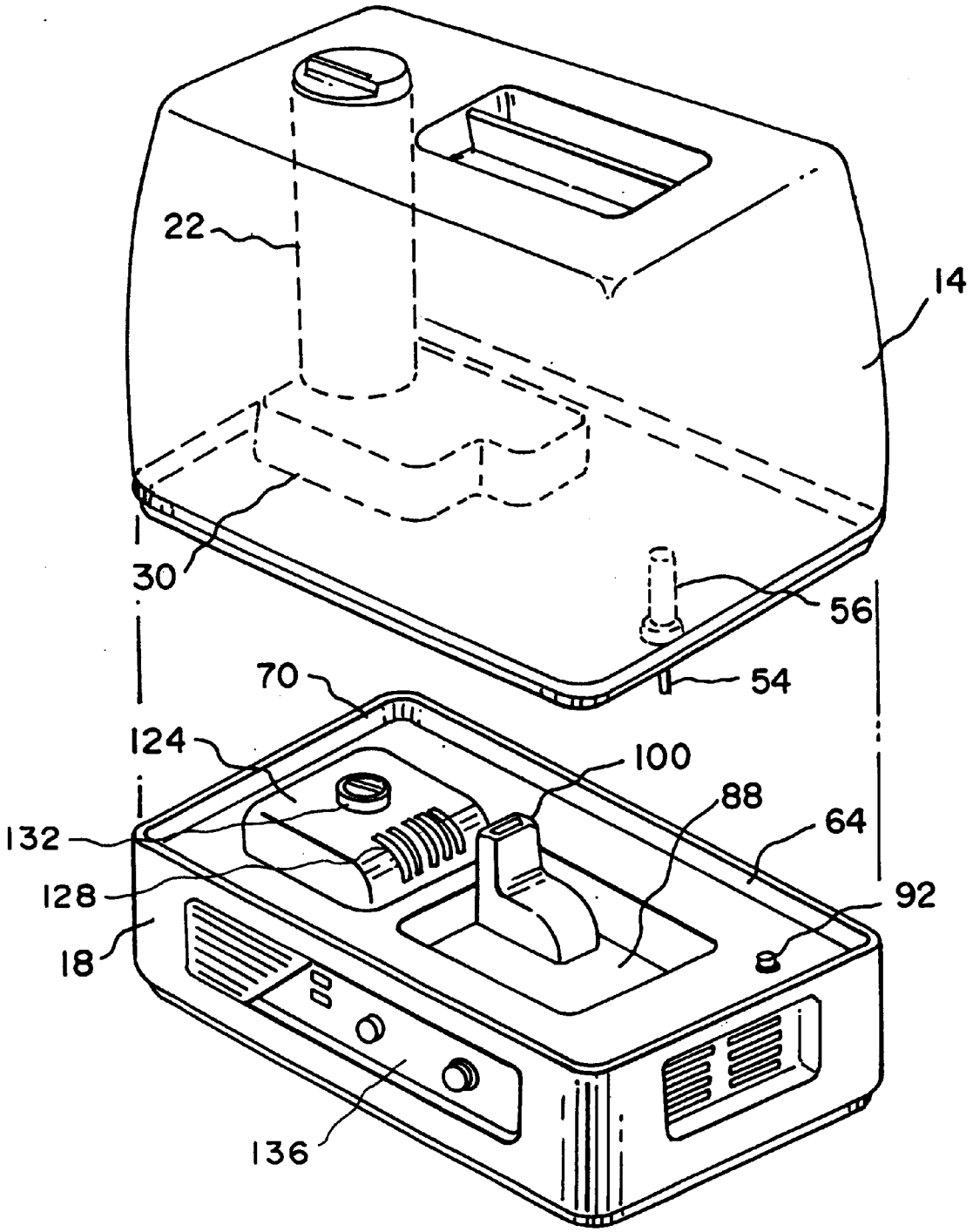
Figure 2:
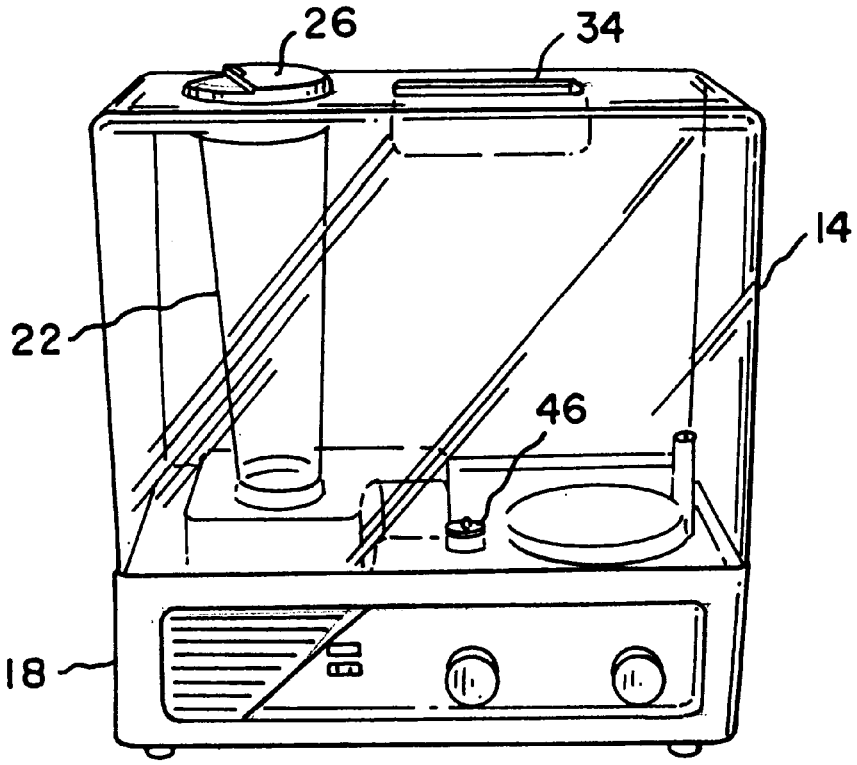
FIG. 2 is a front elevation view of FIG. 1.
Figure 3:
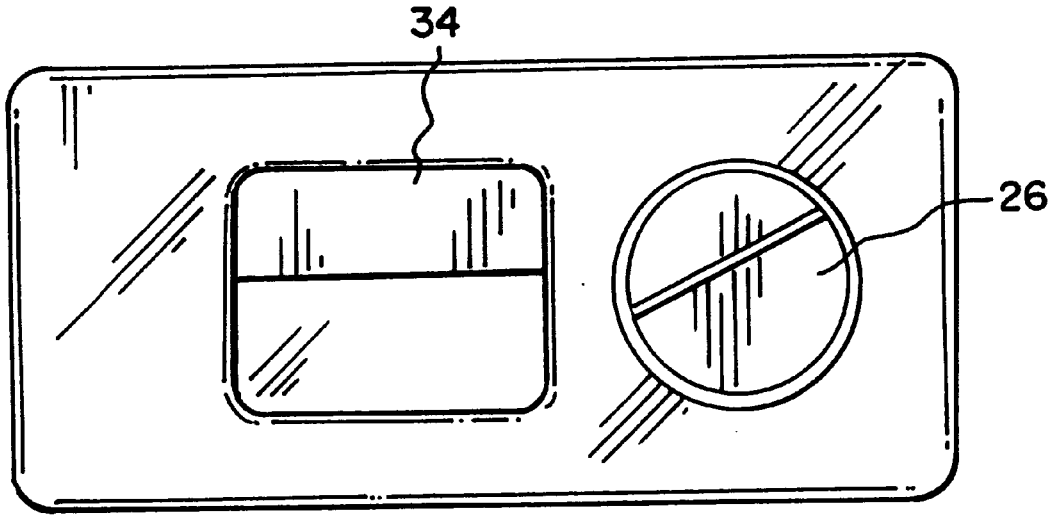
FIG. 3 is top view of FIG. 1.

Referring now to FIGS. 1–10, in which similar or corresponding parts are identified with the same reference numeral, and more particularly to FIGS. 1 and 1A, a preferred embodiment of the invention is illustrated showing a warm mist humidifier 10 that includes a refillable water tank 14 and a base unit 18 for receiving the water tank 14. The water tank 14 contains a vapor passage duct 22 therein to facilitate the dispersion of water vapor from the base unit 18. The discharge opening 24 of the vapor passage duct 22 is fitted with a medication cup 26 with a mist outlet grill 28 for holding liquid medication. The receiving end of the vapor passage duct 22 is surrounded by a receiving channel 30 for communicating with the base unit 18.

The top wall portion of the tank 14 as shown in FIGS. 2–5 has a cavity 32 which is fitted with a tank handle 34 for facilitating the removal the water tank 14 from the base unit 18. The bottom wall portion of the water tank 14 as shown in FIGS. 1, 1A, 2 and 8 includes an opening 36 for filling the water, which is removably sealed by a threaded tank cap 38. A valve assembly 42 is also retained by the bottom wall portion of the water tank 14 for allowing water to flow from the water tank 14 into the base unit 18. The valve assembly 42 includes a valve stem 44 having a spring (not shown) coupled at one end and a valve 46 coupled at the other end. The valve assembly 42 is mounted on an open-ended tubular housing 50 which extends through a discharge opening in the bottom wall portion of the water tank 14. The valve 46 is normally biased into a seated position for closing the discharge opening.

Figure 8:
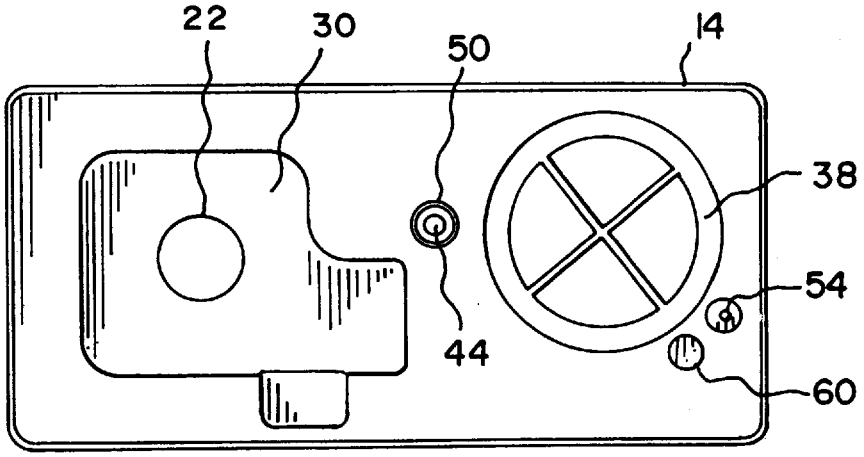
FIG. 8 is a bottom view of a water tank of the warm mist humidifier in accordance with the invention.

Additionally, the bottom wall portion of the water tank 14 as shown in FIG. 1A and 8 has a biased, e.g., spring-loaded, weight sensor 54 mounted on a close-ended tubular housing 56 which projects upwardly from the bottom wall portion of the water tank 14 and prevents the water tank 14 from being fully seated in the base unit 18 unless the threshold water limit is reached. Adjacent to the weight sensor 54 is a cylindrical actuating tab 60 which projects downwardly from the bottom wall of the water tank 14 to contact the tank switch 92 when the water tank 14 is fully seated in the base unit 18.

Figure 4:
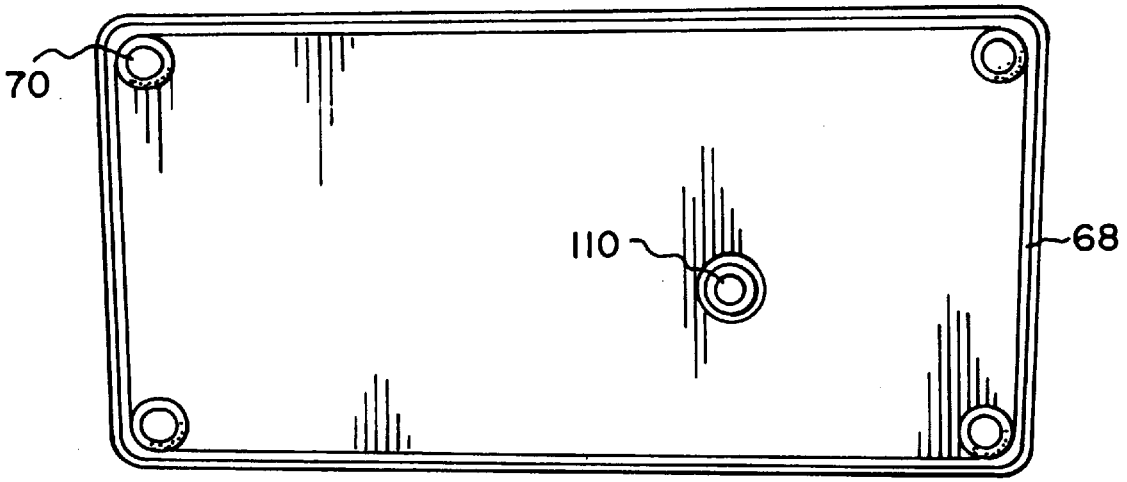
FIG. 4 is a bottom view of FIG. 1.
Figure 5:
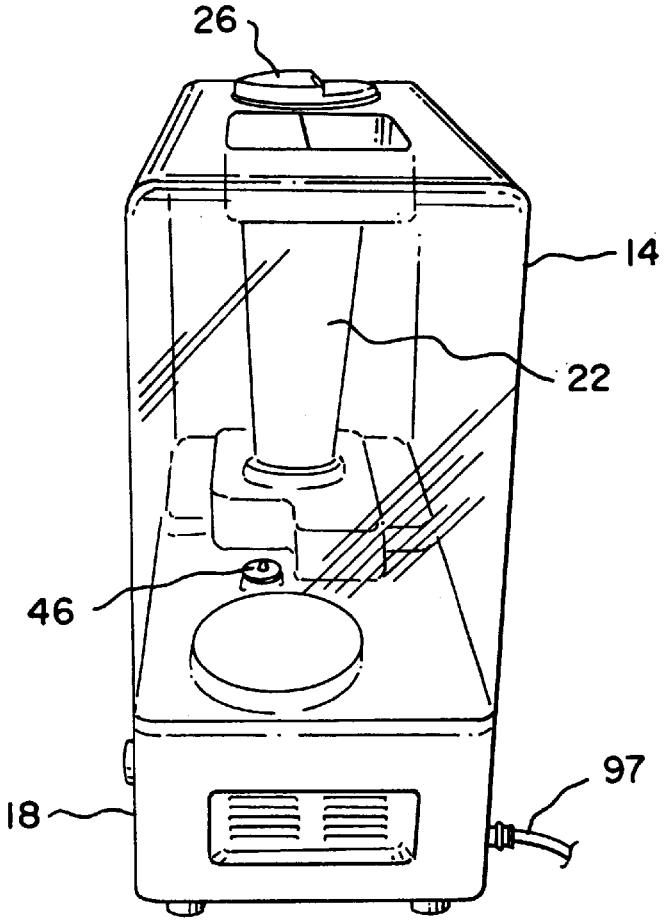
FIG. 5 is a side elevation view of FIG. 1.
Figure 6:
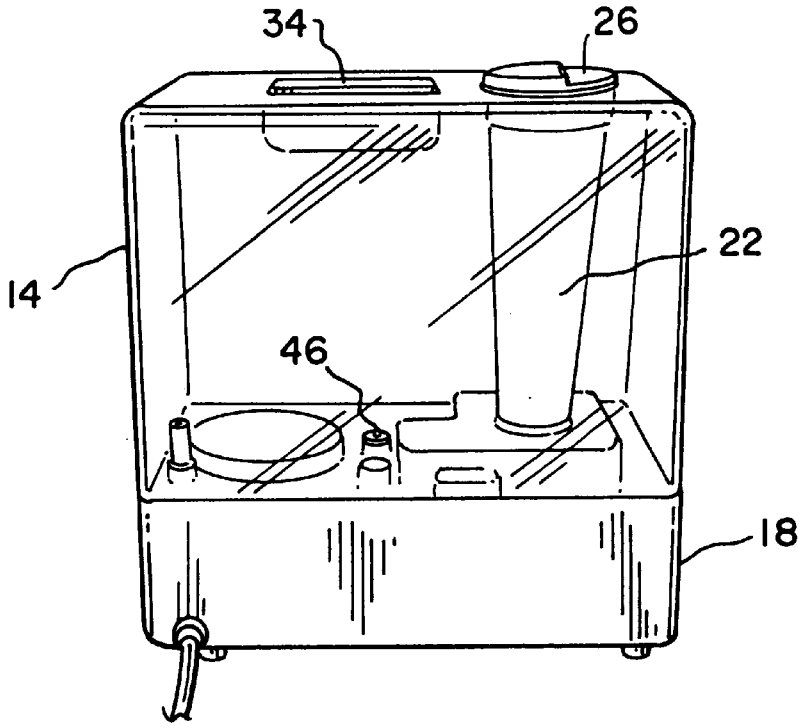
FIG. 6 is a rear elevation view of FIG. 1.

The base unit 18 of the humidifier as shown in FIGS. 1, 1A and 4 includes a top cover 64 covering the top end of the base unit 18 and a bottom cover 68 covering the bottom end of the base unit 18. A peripheral rim portion 70 projects upwardly from the top cover 64 to define a tank enclosure for removably receiving the water tank 14.

Figure 10:
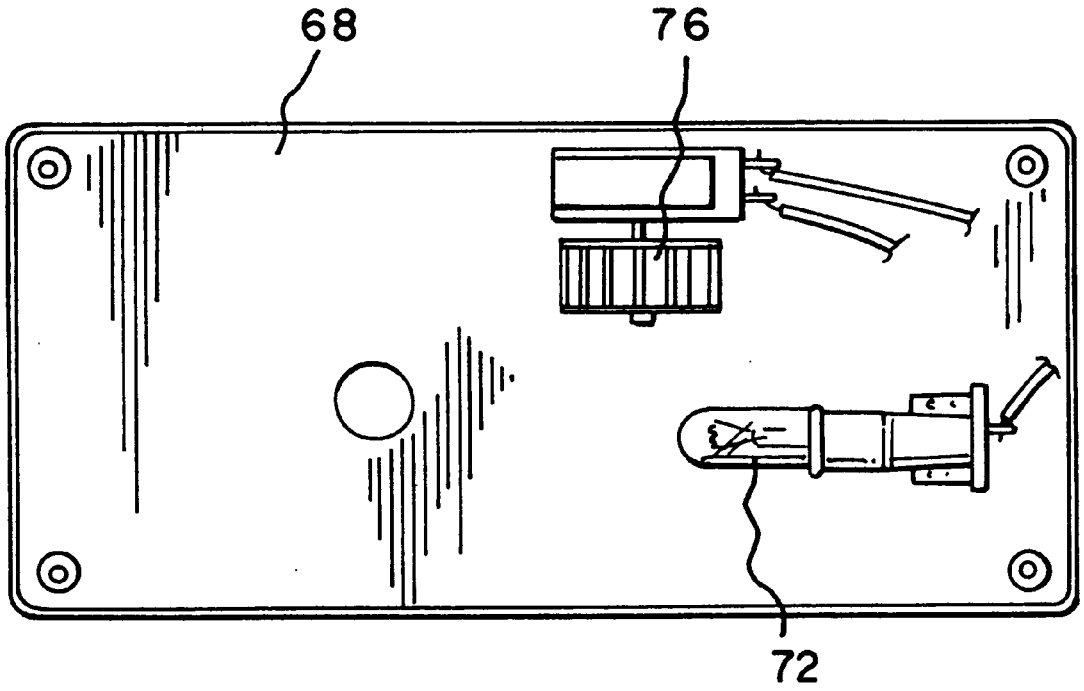
FIG. 10 is a top view of a base cover of the base unit of the warm mist humidifier in accordance with the invention.

As shown in FIGS. 4 and 10, the bottom covers 68 of the base unit 18, which has a plurality of feet 70 extending therefrom, holds a UV germicidal bulb 72 and an air blower 76. The bulb 72, preferably a 3.5 watt bulb capable of operating at maximum output for approximately 2,000 hours (typically 1 to 2 years of normal operation) but may operate longer than 2,000 hours at a reduced output, is capable of eliminating microorganisms in the water. The air blower 76, preferably in the form of an electric motor driven blower contained in a shape housing (not shown) on the bottom cover 68 of the base unit 18, enhances the vapor discharge through the vapor passage duct 22.

Figure 7:
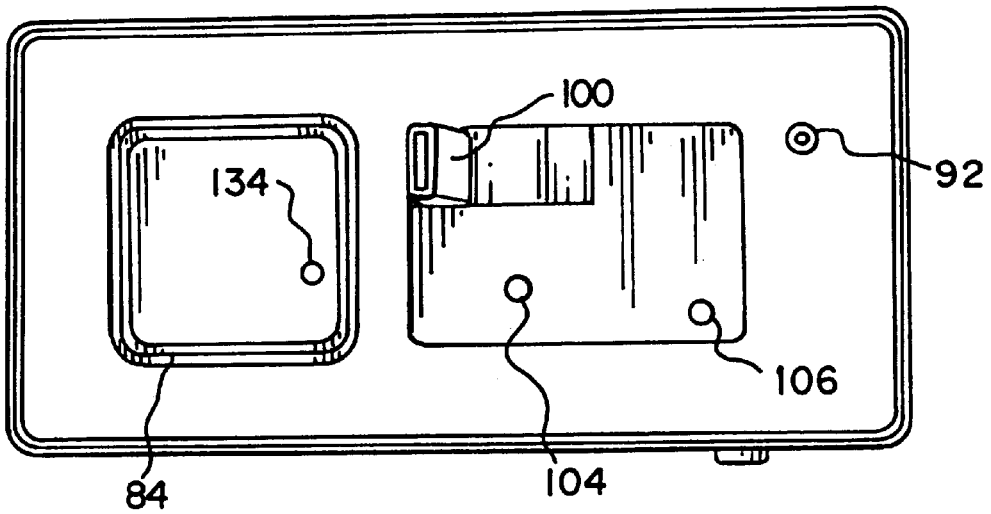
FIG. 7 is a top view of a base unit of the warm mist humidifier in accordance with the invention.

The front of the top cover 64 of the base unit 18 as shown in FIG. 7 has an opening for receiving a heating assembly 84, a reservoir 88 for receiving water from the water tank 14, and an opening for a tank switch 92 which is capable of activating or deactivating an energizing circuitry 96 connected to the heating assembly 84. The energizing circuit 96 as shown in FIGS. 1 and 9 includes an AC electrical cord 97 with an AC plug connector 98 for mating with a conventional electrical receptacle (e.g., wall outlet).

The reservoir 88, which is formed directly below the vapor passage duct 22 of the water tank 14, includes an exhaust opening 100 for directing air from the air blower 76 into the heating assembly 84, a cylindrical valve tab 104 projected from the bottom portion of the reservoir 88 for engaging the valve stem 44, and an outlet 106 for leading water through a water passage tube 108, which is mounted underneath the reservoir 88 and preferably made from glass or other light admitting material, to the heating assembly 84. The water passage tube 108 includes a drain passage 109, which is covered by a threaded drain cap 110 as shown in FIGS. 4 and 9.

Figure 9:
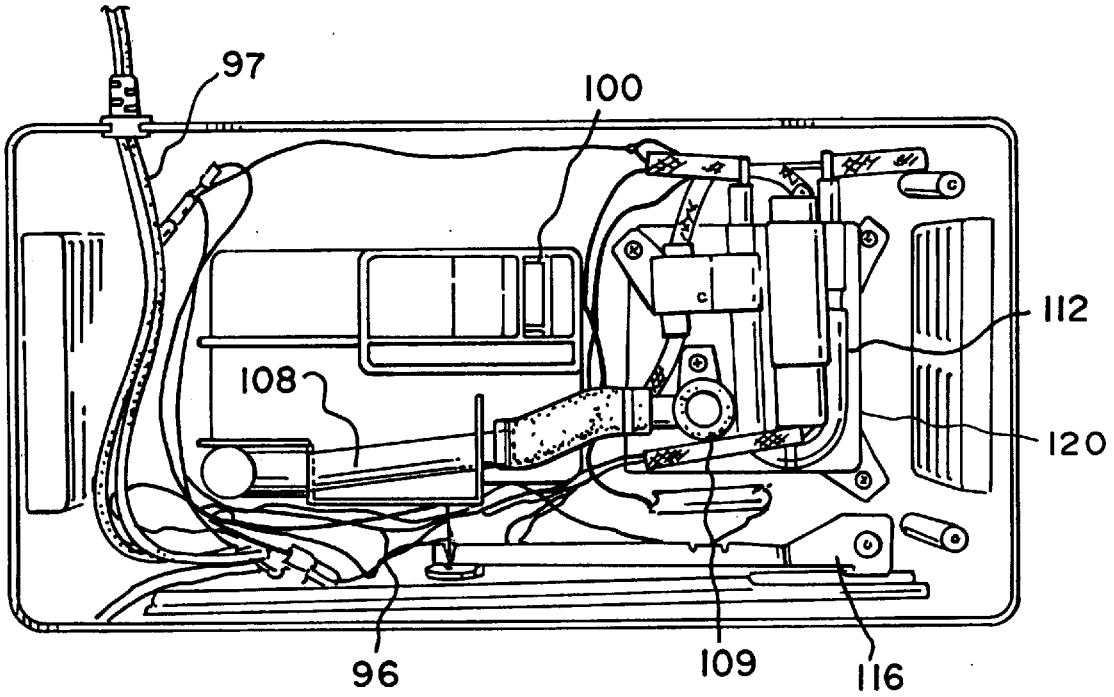
FIG. 9 is a bottom view of a top cover of the base unit of the warm mist humidifier in accordance with the invention.

The heating assembly 84 as shown in FIGS. 1, 7 and 9 includes four main parts, namely a boiler cavity 112 for vaporizing water, a heating coil 116 fixedly mounted underneath the boiler cavity 112 for inducing heat to the boiler cavity 112, an insulative outer housing 120 mounted on the boiler cavity 112, and a removable vapor diffuser 124 covering the insulative outer housing. The vapor diffuser 124 has a plurality of inlet slots 128 for receiving air from the exhaust opening and a plurality of outlet slots 132 for directing the mix of air and warm mist towards the vapor passage duct 22. The boiler cavity 112 has an opening 134 for receiving water from the water passage tube 108. When the heating coil is energized, warm mists are generated in the boiler cavity 112, and these warm mists rise and escapes through the vapor passage duct 22.

The tank switch 92, which is adjacent to the reservoir 88, controls the heating coil 116 based on the weight of the water tank 14. More specifically, the condition of the tank switch 92 is controlled by the movement of the water tank 14 between activating and inactivating positions in response to a decrease in the water level (i.e., decrease in the weight of the water within the water tank 14), or removal of the water tank 14 from the base unit 18. The front of the base unit 18 as shown in FIG. 1 includes a control panel 136 having an ON/OFF switch knob 140, a refill indicator 144, a reset button 148, and a UV bulb indicator 152. The humidifier is activated when the ON/OFF control knob 140 is turned to the "ON" setting while the humidifier is supplied with electrical energy in the form of electrical current from an AC supply such as a household outlet. The illumination of the refill indicator 144 and/or the UV bulb indicator 152 indicates the need to refill the water tank 14 and/or replace the UV bulb.

OPERATION

To prepare the humidifier 10 for use, the water tank 14 is removed from the base unit 18 using the tank handle 34, and then the water tank 14 is filled with water through the opening 36 created by the removal of the tank cap 38. When the water tank 14 is removed from the base unit 18, the tank switch 92 stops engaging the weight sensor 54, thereby shutting off the heating coil 116.

With the tank cap 38 secured, the water tank 14 is inverted and positioned on the base unit 18 so that (1) the spring-loaded valve 42 is pushed into an open position, (2) the spring-loaded weight sensor 54 is depressed, and (3) the actuating tab 60 from the water tank operatively engages the tank switch 92, thereby activating the tank switch 92 to energize the heating coil 116, which induces heat to the boiler cavity 112.

When the water level in the water tank 14 falls to a predetermined level or the combined weight of the water tank 14 and water contained therein decreases below a threshold level, the biased weight sensor 54 at least partially dislodges the water tank 14 from the base unit 18 as to cause the actuating tab 60 to disengage the tank switch 92, thereby deactivating the tank switch 92 and de-energizing the heating coil 116 without having to remove the water tank 14 from the base unit 18. When the water tank 14 is removed from the base unit 18, actuating tab 60 is also disengaged from the tank switch 92, thereby deactivating and de-energizing the heating coil 116.

The humidifier 10 eliminates the potentially harmful microorganisms in the water by using the UV germicidal bulb 72, located inside the base unit 18, to shine on the water through a glass tube as it passes from the reservoir 88 to the boiler cavity 112.

To facilitate the dispersion of water vapor from the boiler cavity 112 into air by way of vapor passage duct 22 through the water tank 14, an electric fan 76 is disposed in the base unit 18 to draw air into the boiler cavity by way of an air duct.

While a particular embodiment of the present invention have been shown and described, it will be apparent to those skilled in the art that various changes and modifications may be made therein without departing from the spirit or scope of the invention. Accordingly, it is intended that the appended claims cover such changes and modifications that come within the spirit and scope of the invention.

What is claimed is:

1. A warm mist humidifier with an air blower comprising:

a base unit having an energizing circuit;

a water tank having a weight sensor and disposed on said base unit for supplying water to said unit;

a heater disposed in said base unit for vaporizing water received from said water tank when said heater is activated by said energizing circuit;

a tank switch for activating or deactivating said energizing circuit; and an actuating tab fixedly attached to said water tank for engaging or disengaging said tank switch in said base unit, wherein said tank switch is responsive to a change of position of the water tank relative to the base unit in response to the amount of water in said water tank.

2. The warm mist humidifier of claim 1, further comprising a reservoir in said base unit for receiving water from said water tank, wherein said heater disposed in said base unit vaporizes water received from said reservoir.

3. The warm mist humidifier of claim 2, further comprising a water passage means for transporting water from said reservoir to said heater, wherein said water passage means is at least partially made from a light admitting material.

4. The warm mist humidifier of claim 3, further comprising a germicidal bulb for eliminating potentially harmful microorganisms in water, said germicidal bulb disposed opposite said water passage means.

5. The warm mist humidifier of claim 4, wherein said base unit comprises a bottom cover and a top cover, said top cover supporting said reservoir and said bottom cover supporting said germicidal bulb and said air blower.

6. The warm mist humidifier of claim 1, wherein said heater comprises a boiler unit defining a cavity, a heating coil fixedly mounted underneath the boiler unit, an insulative outer housing mounted on the boiler unit surrounding the cavity, and a removable cover covering the insulative outer housing.

7. The warm mist humidifier of claim 1, wherein said tank switch is deactivated when said water tank is dislodged from said base unit.

8. The warm mist humidifier of claim 1, wherein said tank switch is deactivated when said water tank is entirely removed from said base unit.

9. A warm mist humidifier with an air blower comprising:

a base unit having an energizing circuit;

a water tank disposed on said base unit for supplying water to said base unit;

a reservoir in said base unit for receiving water from said water tank;

a heater disposed in said base unit for vaporizing water received from said reservoir when said heater is activated by said energizing circuit;

a tank switch for activating or deactivating said energizing circuit; and an actuating tab fixedly attached to said water tank for engaging or disengaging said tank switch in said base unit, wherein said heater comprises a boiler unit defining a cavity, a heating coil fixedly mounted underneath the boiler unit, an insulative outer housing mounted on the boiler unit surrounding the cavity, and a removable cover covering the insulative outer housing.

10. The warm mist humidifier of claim 9, further comprising a reservoir in said base unit for receiving water from said water tank, wherein said heater disposed in said base unit vaporizes water received from said reservoir.

11. The warm mist humidifier of claim 10, further comprising a water passage means for transporting water from said reservoir to said heater, wherein said water passage means is at least partially made from a light admitting material.

12. The warm mist humidifier of claim 11, further comprising a germicidal bulb for eliminating potentially harmful microorganisms in water, said germicidal bulb disposed opposite said water passage means.

13. The warm mist humidifier of claim 12, wherein said base unit comprises a bottom cover and a top cover, said top cover supporting said reservoir and said bottom cover supporting said germicidal bulb and said air blower.

* * * * *